US007954484B2

(12) United States Patent
Snell

(10) Patent No.: US 7,954,484 B2
(45) Date of Patent: Jun. 7, 2011

(54) SPLITTING DEVICES

(76) Inventor: Thomas Bartlett Snell, Sherborne (GB)

( * ) Notice: Subject to any disclaimer, the term of this patent is extended or adjusted under 35 U.S.C. 154(b) by 627 days.

(21) Appl. No.: 11/990,106

(22) PCT Filed: Aug. 14, 2006

(86) PCT No.: PCT/GB2006/003026
§ 371 (c)(1),
(2), (4) Date: Feb. 6, 2008

(87) PCT Pub. No.: WO2007/020414
PCT Pub. Date: Feb. 22, 2007

(65) Prior Publication Data

US 2010/0269811 A1 Oct. 28, 2010

(30) Foreign Application Priority Data

Aug. 12, 2005 (GB) ..... 0516580.8

(51) Int. Cl.
*B28D 1/32* (2006.01)

(52) U.S. Cl. ..... 125/23.01; 125/40

(58) Field of Classification Search ..... 125/23.01, 125/35, 40, 41
See application file for complete search history.

(56) References Cited

U.S. PATENT DOCUMENTS

| | | | | |
|---|---|---|---|---|
| 2,777,438 | A * | 1/1957 | Mangis | 125/23.01 |
| 2,798,475 | A * | 7/1957 | Hoose | 125/23.01 |
| 2,867,205 | A * | 1/1959 | Vesper | 125/23.01 |
| 2,912,970 | A * | 11/1959 | Schlough et al. | 125/23.01 |
| 4,243,012 | A * | 1/1981 | Keck | 125/23.01 |
| 4,541,405 | A * | 9/1985 | Schlough | 125/23.01 |
| 6,050,255 | A * | 4/2000 | Sievert | 125/23.01 |
| 6,401,706 | B1 * | 6/2002 | Hernblom et al. | 125/23.01 |
| 6,568,577 | B2 * | 5/2003 | Baird et al. | 225/103 |
| 6,668,816 | B1 * | 12/2003 | Pedersen et al. | 125/23.01 |
| 6,827,073 | B1 * | 12/2004 | Morrell | 125/23.01 |
| 7,107,982 | B1 * | 9/2006 | Lechner | 125/23.01 |
| 7,708,005 | B2 * | 5/2010 | Lackner | 125/23.01 |
| 2003/0089363 | A1 * | 5/2003 | Suto et al. | 125/23.01 |
| 2005/0268901 | A1 * | 12/2005 | Scherer | 125/23.01 |
| 2008/0047539 | A1 * | 2/2008 | Scherer et al. | 125/23.01 |

* cited by examiner

*Primary Examiner* — Eileen P. Morgan
(74) *Attorney, Agent, or Firm* — Alfred A. Fressola; Ware, Fressola, Van Der Sluys & Adolphson LLP

(57) ABSTRACT

An apparatus for splitting stones and blocks comprises means (5A, 6A) for supporting a stone or block while it is subject to a splitting operation, a unit which includes an upper blade (1) for engaging an upper surface of the stone or block and a lower blade (10) for engaging a lower surface of the stone or block, means (5) for effecting movement of the upper blade (1) downwardly towards the lower blade (10), a base (1A, 3A), and resilient support means (11) acting between the base (1A, 3A) and the unit.

8 Claims, 3 Drawing Sheets

SPLITTING DEVICES

FIELD OF THE INVENTION

This invention relates to splitting devices.

Stones, concrete blocks and synthetic stones are split in order to reduce their size, change their shape and to provide a split face that is aesthetically pleasing. These are used for house walls for building, for wall cladding, for perimeter walls, for landscaping, rockeries, flooring, paving and the like.

Stone may be randomly shaped as quarried from the ground or it may be sawn partially or fully on six faces prior to splitting. The sawn blocks may be in the form of very long slabs and concrete or synthetic products will normally be cast or moulded prior to splitting and often in long length slabs.

Splitting machines normally have top and bottom blades. The stone or block is located between the two blades and the stone is split by the reducing gap between the blades. The bottom blade may be fixed in position with the top blade pulled or pushed towards the bottom blade, in some cases by hydraulic force. When the stone or block is being split the bottom blade will penetrate the bottom side of the stone or block to a certain depth, dependant on the composition of the material. The bottom blade will normally penetrate soft stone to a greater depth than hard stone, prior to splitting.

Stones or blocks may be placed on the bottom blade, the cutting edge of which is above, and may stand proud of, a support platform that stabilises the stone or block on either side of the blade. An elastic support such as a rubber or polymer support wedge may also be used to stabilise the stone or block.

Beds may be provided for supporting the stones or blocks and for feeding them into the required position for splitting to be carried out. These may be flat, made up of rollers or in the form of conveyors. A stone or block to be split may be easily slid by hand or moved by power means into the required position without it requiring to be lifted over the bottom blade. When the stone or block is split, the bed descends exposing the fixed bottom blade so that the force of the downwardly moving top blade pushes the stone or block onto the bottom blade that penetrates to the point of splitting the stone or block. Once the stone or block has been split, the bed is then free to return to its original position.

Sprung beds have a number of drawbacks, and these include being difficult to adjust for different hardnesses of stone and block, an inability to handle small soft stones as a result of the stones breaking rather than splitting before the bottom blade has penetrated the lower surface of the stone from the descending force of the top blade and the sprung resistance of the platform, and a tendency to move out of adjustment at frequent intervals.

Spring mechanisms below roller beds can quickly clog with splitting debris. Different sizes and types of materials need different settings and, if the machine is not set correctly or the top blade is allowed to force an offcut between the blade and the bed or conveyor, damage can occur. When a stone is split there is a sudden release of energy from the spring mechanism returning to its uncompressed state, and this can catapult stone or blocks causing potential damage or injuries.

An object of the present invention is the provision of an improved apparatus for splitting stones and blocks.

In British Patent Specification No. 2 331 483 there is described a splitter for splitting stone, concrete, wood and the like comprising a frame, a first splitter blade having a blade edge and being movable, relative to the frame, in advancing and retracting movements, guide means for guiding opposite end portions of the first splitter blade in its advancing and retracting movements, a second splitter blade, and hydraulically actuable means connected to the first splitter blade and arranged to pull both ends of the first splitter blade towards the second splitter blade.

It is a further object of the present invention to provide an apparatus for splitting stones and blocks that has advantages as compared to the apparatus shown in British Patent Specification No. 2 331 483.

SUMMARY OF THE INVENTION

According to the present invention there is provided an apparatus for splitting stones and blocks comprising means for supporting a stone or block while it is subject to a splitting operation, a unit which includes an upper blade for engaging an upper surface of the stone or block and a lower blade for engaging a lower surface of the stone or block, means for effecting movement of the upper blade downwardly towards the lower blade, a base, and resilient support means acting between the base and the unit.

Other preferred features of the invention are set out in the subsidiary claims appended hereto.

DESCRIPTION OF THE PREFERRED EMBODIMENT

Figure 1:
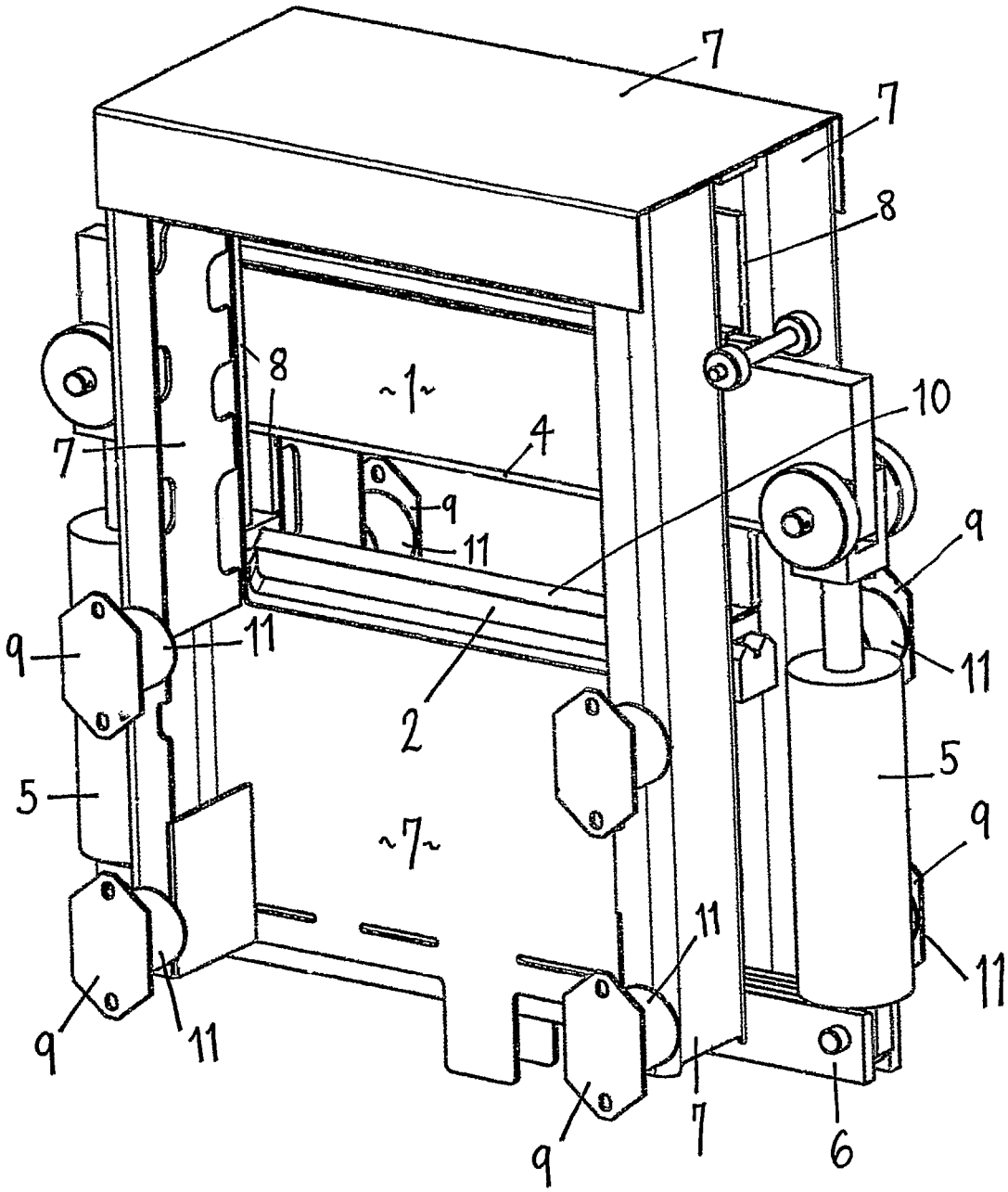
FIG. 1 is a perspective view of an inner unit of a splitting device.

The inner unit of the apparatus is shown in FIG. 1 of the drawings and includes an upper blade carrier 1, with a blade insert 4. The upper blade carrier 1 is movable up and down whilst being permitted some lateral movement and, in this instance is drawn towards the stone or block to be split by two retracting hydraulic rams 5. The blade carrier 1 is guided by flat guides 8 acting on the front and rear faces of the blade 4. The hydraulic rams 5 are attached to a beam 6 that is attached to a frame 7, and the guides 8 are also attached to the frame 7.

The apparatus also includes a lower blade carrier 2 that incorporates a blade insert 10 and the lower blade carrier 2 is also attached to the frame 7. Frame 7 has eight elastic mounts 11 attached to it and the mounts 11 are of cylindrical shape, with four in front of the frame 7 and four to the rear of the frame 7. The elastic mounts 11 may be of natural or synthetic rubber, or in the form of coil springs or other elastic means and there may be any number of them. As shown, the elastic mounts 11 incorporate plates or other attachment means 9.

Figure 2:
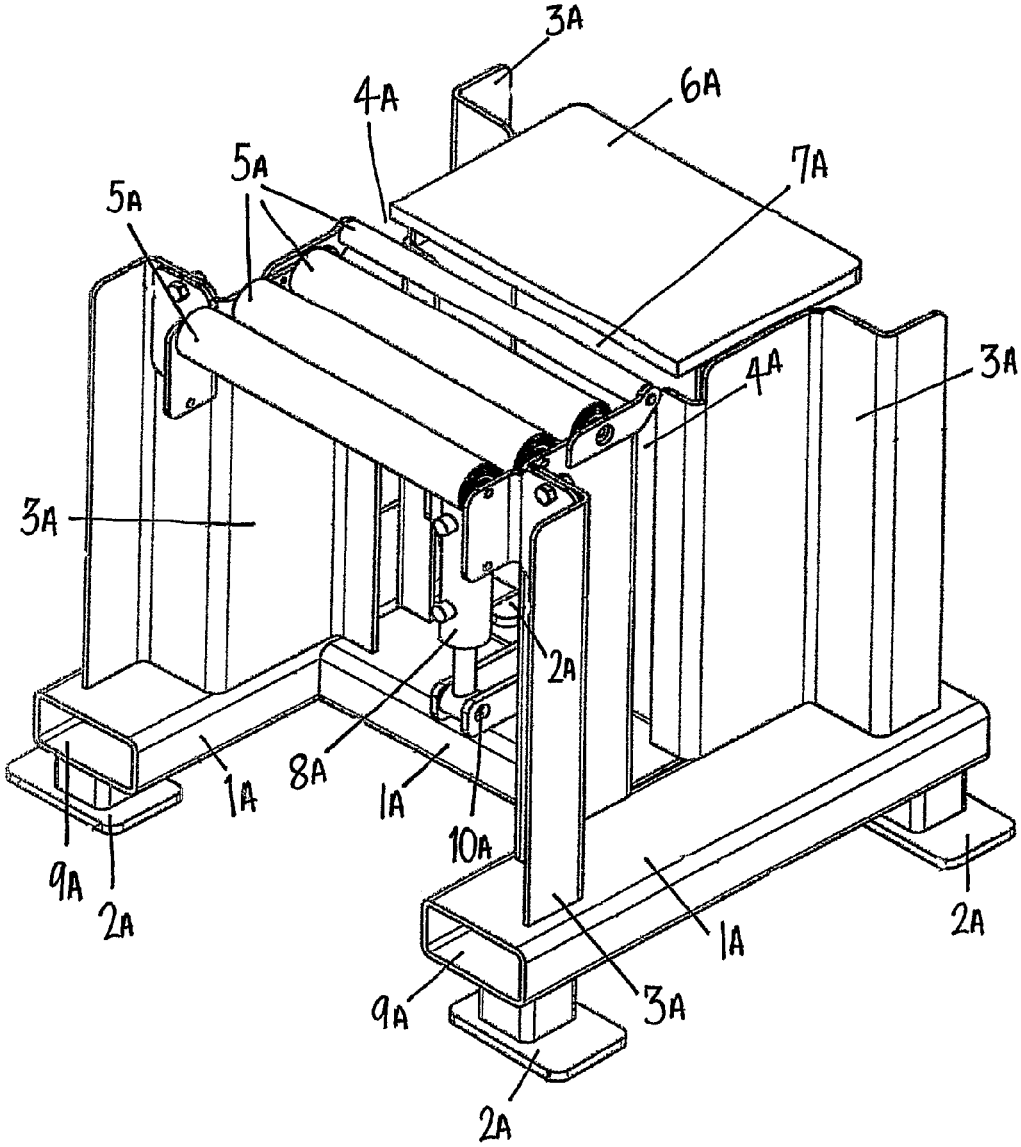
FIG. 2 is a perspective view of an outer unit of the splitting device.

The outer unit of the apparatus is shown on its own in FIG. 2 and includes a base frame 1A that is mounted on feet 2A and supports uprights 3A with a gap 4A between the front pair of uprights 3A and the rear pair of uprights 3A. The base frame 1A is made from rectangular-section tubular members and has apertures 9A for receiving the forks of forklift trucks to facilitate handling of the apparatus. The uprights 3A are arranged so that there is a gap 4A between the front and rear pairs of uprights 3A and there are rollers 5A spanning the front pair of uprights 3A and a flat bed 6A spanning the rear pair of uprights 3A. There is also a gap 7A between the rollers 5A and the flat bed 6A. As an alternative to the arrangement shown in FIG. 2, rollers may be provided spanning both pairs of uprights 3A, flat beds may be provided spanning both pairs of uprights 3A, or both the rollers 5A and the flat bed 6A may be replaced by conveyors.

A hydraulic ram 8A is attached to the base 1A by means of a pin 10A. There may be a single hydraulic ram 8A, as shown, but preferably two hydraulic rams, one in the front part of the apparatus and the other in the rear part of the apparatus. As shown, the base frame 1A is of H configuration in plan view.

Figure 3:
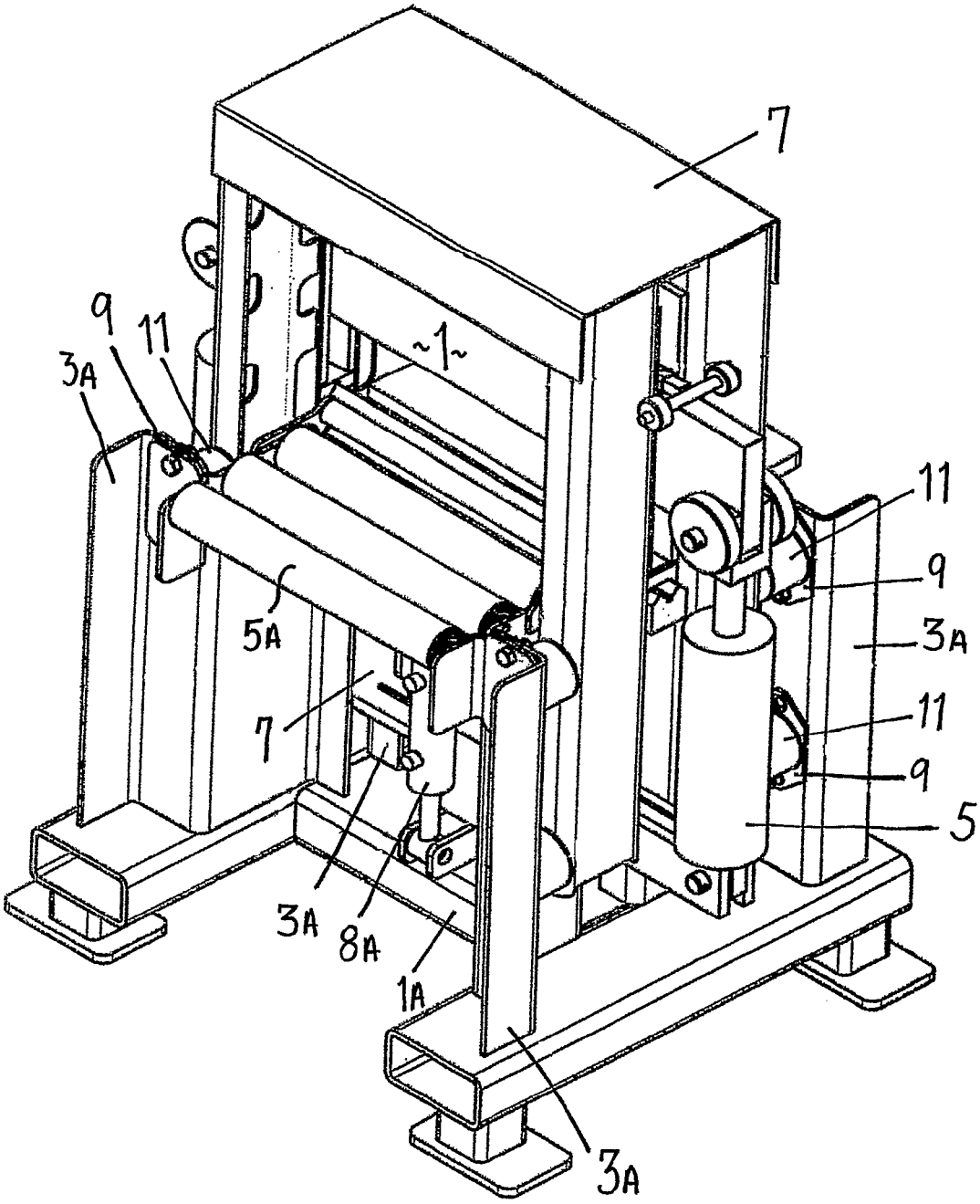
FIG. 3 is a perspective view of the complete splitting device.

The outer unit shown in FIG. 2 receives the inner unit of FIG. 1 in the manner shown in FIG. 3 with the elastic blocks 11 attached to the four uprights 3A via the plates 9. The inner and outer units are thus connected together by means of elastic joints. The ram 8A is attached to the base 1A of the outer unit and to an inner frame member 7 forming part of the inner unit so that, when the ram 8A is actuated the entire inner unit is moved up or down in relation to the outer unit.

The inner unit may rest on stops (not shown) as a start position. In this position, the inner unit is in its lowermost position in relation to the outer unit with the lower blade 10 below the level of the top of the rollers 5A or flat bed or conveyors, allowing stones or blocks to be freely moved over the lower blade 10 without lifting them. Please note that FIG. 3 shows the lower blade 10 projecting just above the level of the top of the rollers 5A.

It is to be noted that the apparatus is of particular advantage as regards the splitting of a series of long blocks in that the series of blocks can be fed to the splitting location without any likelihood of there being a variation in the height at which the blocks are supported.

The upper blade carrier 1 is movable up and down whilst being permitted some lateral movement and is drawn towards the stone or block to be split by the two retracting hydraulic rams 5. The upper blade carrier 1 is guided by the flat guides 8 acting on the front and rear faces of the blade. The hydraulic rams 5 are attached to a beam 6 that is attached to the frame members 7, and the guides 8 are also attached to the frame members 7. The beam 6 is located in the gap 4A between the front and rear pairs of uprights 3A of the outer unit.

With a stone or block spanning but not in contact with the lower blade 10, the upper blade may be moved in a generally downward direction by operation of the retracting rams, closing the gap between the upper and the lower blades. As the upper blade makes contact with the top of the stone or block and continues to descend, the inner unit is then raised by operation of the rams 8A so that the lower blade also makes contact with the lower face of the stone or block. Further movement will split the stone or block. The elastic blocks 11 are moving substantially in vertical shear but they are also able to move a small extent in tension and compression. They are also capable of being moved in lateral shear but this would not normally be required to any extent.

The inner unit, which is mounted on the outer unit by means of elastic joints may also rotate to a small degree, one unit in relation to the other.

In the above-described splitting action, the force of the upper blade is transferred through the stone or block to the rollers, beds or conveyors that are fixed and integral with the outer unit, the force required to lift the lower blade 10 to make initial contact with the underside of the stone comprises almost entirely of the weight of the inner unit and any resistive forces provided by the elastic blocks 11 in vertical shear.

In some instances, this can be undesirable particularly in relation to softer stone or blocks that usually require greater blade penetration before splitting thus requiring greater movement of the inner frame in relation to the outer frame and resulting in greater shear resistance from the elastic blocks.

If the stone is soft and relatively small or thin, the stone or block can break before the lower blade has made contact.

To overcome this situation and to minimise any forces on the beds, rollers or conveyors, the hydraulic ram 8A acts as an assistor ram that helps lift the inner unit and may be configured automatically to operate in conjunction with the main retractor or splitting rams 5. In normal use, it is important however that the assistor ram does not lift the lower blade before the top blade has engaged with the top face of the stone, as the stone or block would lose full contact with the beds or rollers and be unbalanced and out of level spanning the now raised lower blade.

It would be normal for the assistor ram 8A to work at all times automatically except when handling very soft small stones and blocks, in which case the assistor ram may bring the lower blade up to contact the base of the stone and then the upper blade moved down to the top of the stone so that the stone is gently gripped. The inner unit may then be further moved upwards so that the grip on the stone is increased before the upper blade is moved towards the lower blade thereby splitting the stone, without the stone being in contact with the fixed bed.

It will be appreciated that these various actions may be controlled manually, automatically or by a programme with monitoring where required. The actuating devices described are hydraulic but could be by mechanical, electro-mechanical or any other means.

The inner unit, whilst maintaining a rest or start position is capable of moving not only upwards but also may be arranged to move laterally if required and to and fro between the roller bed and the flat bed and to move in the roll plane.

The elastic blocks 11 can be arranged to work in shear, in compression or extension or a combination of actions, and elasticity could be provided by fluid means. In any event, the inner unit (shown in FIG. 1) comprising the upper and lower blades move as a unit in relation to the outer unit (shown in FIG. 2).

The inner unit is urged to a neutral start position relative to the outer unit by the elastic blocks 11 and resilient guidance is also provided by the latter.

It will also be appreciated that the beds may be supported by other means than the outer unit and may, for example, be overhanging cantilevers fixed to the floor or fixed to other structures.

It will further be appreciated that whilst the above system is designed to work in a vertical situation with the material to be split on a horizontal surface, other attitudes are possible.

The invention claimed is:

1. An apparatus for splitting stones and blocks comprising:

means for supporting a stone or block while it is subject to a splitting operation;

a unit which includes a frame, an upper blade for engaging an upper surface of the stone or block, a lower blade, the lower blade for engaging a lower surface of the stone or blade, and means for effecting movement of the upper blade relative to the frame in a direction towards the lower blade;

a base;

means for moving the unit comprising the upper blade and the lower blade relative to the base, so that the lower blade makes contact with a lower face of the stone or block; and resilient support means acting between the base and the unit, said resilient support means comprising a plurality of elastic blocks and a corresponding plurality of plates affixed thereto, the plates attached to uprights of the frame and positioned for movement relative to the base so as to allow the plurality of elastic blocks and thereby the unit to be urged to a neutral position relative to the base as well as to provide resilient guidance of the unit relative to the base so as to reliably split a stone or block supported by said means for supporting.

2. An apparatus as claimed in claim 1 in which the means for supporting the stone or block is connected integrally to the base.

3. An apparatus as claims in claim 1 in which the means for effecting movement of the upper blade downwardly towards the lower blade comprises hydraulic rams.

4. An apparatus as claimed in claim 1 in which the means for moving the unit relative to the base comprises one or more hydraulic rams.

5. An apparatus as claimed in claim 1 in which the means for supporting the stone or block includes a plurality of rollers.

6. An apparatus as claimed in claim 1 in which the means for supporting the stone or block includes one or more flat beds.

7. An apparatus as claimed in claim 1 in which the resilient support means acting between the base and the unit comprises a plurality of elastic blocks.

8. An apparatus as claimed in claim 1, wherein the upper blade is mounted to an upper blade carrier, the upper blade carrier positioned in guides mounted to the frame so as to allow movement of the upper blade relative to the frame and wherein the lower blade is mounted to a lower blade carrier to the frame.

* * * * *